US005164100A

United States Patent [19]

Langer et al.

[11] Patent Number: 5,164,100

[45] Date of Patent: Nov. 17, 1992

[54] FABRIC SOFTENER COMPOSITIONS CONTAINING A POLYMERIC FLUORESCENT WHITENING AGENT

[75] Inventors: Matthew E. Langer, New York, N.Y.; Ferial Khorshahi, Leonia; John F. Hessel, Metuchen, both of N.J.; Simon R. Ellis, Little Sutton, United Kingdom

[73] Assignee: Lever Brothers Company, Division of Conopco, Inc., New York, N.Y.

[21] Appl. No.: 767,287

[22] Filed: Sep. 27, 1991

Related U.S. Application Data

[63] Continuation-in-part of Ser. No. 626,074, Dec. 11, 1990, Pat. No. 5,082,578.

[51] Int. Cl.[5] ..... D06M 15/19

[52] U.S. Cl. ..... 252/8.6; 252/8.8; 252/8.9; 252/174.23; 8/647; 8/648

[58] Field of Search ..... 252/8.8, 8.9, 8.6, 174.23, 252/DIG. 2, 543, 132; 8/647, 648

[56] References Cited

U.S. PATENT DOCUMENTS

| | | | |
|---|---|---|---|
| 3,959,230 | 5/1976 | Hays | 528/297 |
| 4,420,607 | 12/1983 | Morris et al. | 528/298 |
| 4,459,402 | 7/1984 | Morris et al. | 528/298 |
| 4,569,772 | 2/1986 | Ciallella | 252/8.6 |
| 4,702,857 | 10/1987 | Gosselink | 252/174.21 |
| 4,728,719 | 5/1988 | Morris et al. | 528/306 |
| 4,728,720 | 5/1988 | Morris et al. | 528/306 |
| 4,739,033 | 4/1988 | Morris et al. | 528/306 |
| 5,082,578 | 1/1992 | Langer et al. | 252/8.6 |

*Primary Examiner*—Anthony McFarlane
*Assistant Examiner*—C. Everhart
*Attorney, Agent, or Firm*—Ronald A. Koatz

[57] ABSTRACT

The present invention pertains to fabric softener compositions comprising a surfactant, a fatty acid and a polymeric whitening agent which contains both a fluorescent portion and a hydrophilic portion. Applicants have shown that the polymers can be used in (1) softener compositions wherein biodegradable cationic surfactants are used; and (2) in concentrated softener compositions (i.e., compositions containing 40–80% fabric softener). In concentrated compositions, desirably the use of FFA is minimized or eliminated.

17 Claims, No Drawings

FABRIC SOFTENER COMPOSITIONS CONTAINING A POLYMERIC FLUORESCENT WHITENING AGENT

CROSS REFERENCES

This is a Continuation-in-Part of Ser. No. 07/626,074 filed Dec. 11, 1990, now U.S. Pat. No. 5,082,578.

BACKGROUND OF THE INVENTION

1. Field of the Invention

This invention relates to fabric softener compositions containing a surface active component and a polymeric whitening agent which contains at least one fluorescent monomer component and one hydrophilic monomer component. The polymeric whitening agent may optionally contain a hydrophobic monomer component. The polymeric whitening agents in these compositions provide enhanced fluorescence when used on hydrophilic and/or hydrophobic substrates.

2. Prior Art

Conventional fluorescent whitening agents (FWAs) for textiles have been used for many years as optical brighteners for fabric. These materials function by replacing the blue-violet component of visible light depleted by chromophore-containing soils in the form of blue fluorescence. This replacement reduces and/or eliminates the yellow tinge cast onto dingy fabrics by completing the full complement of visible light colors, leading to white light with a brightening effect.

FWAs currently used in detergent formulations are generally sulfonic acid salts of diaminostilbene derivatives such as those taught, for example, in U.S. Pat. No. 2,784,220 to Spiegler or U.S. Pat. No. 2,612,501 to Wilson. FWAs of this type have been long known to significantly "whiten" cotton. However, their brightening effect on less hydrophilic fabric, especially aged cotton, is substantially reduced. The most likely explanation for this phenomenon is that, while sulfonic acid salts of diaminostilbene fluorescent whitening agents are able to hydrogen bond to hydroxyls on the surface of cellulose via the sulfonate anion - hydroxyl proton hydrogen bonding interaction, this effect is reduced in polyester/-cotton blends and is altogether absent in pure polyester. In the case of soiled cotton, oily soil residue can hydrophobically modify the surface of cellulose, deterring the deposition of hydrophilic FWAs.

It has been demonstrated that poly(ethylene terephthalate)/poly(oxyethylene terephthalate) copolymers adsorb onto hydrophobic surfaces to confer soil release properties. See U.S. Pat. No. 4,702,857 to Gosselink; U.S. Pat. No. 4,569,772 to Ciallela; and U.S. Pat. No. 3,959,230 to Hays. These materials are believed to function by hydrophilically modifying a hydrophobic surface (such as oily soil on fabric or polyester fabric itself), and thereby deterring deposition of hydrophobic soils. The poly(ethylene terephthalate) unit is believed to seek and adhere to the hydrophobic surface; the poly(ethylene glycol) portion is believed to give hydrophilic character to the fabric surface as well as aid the polymer in transfer through the aqueous medium. None of these references teach or suggest the use of a copolymer comprising a hydrophilic portion (capable of delivering the copolymer through an aqueous system) and a fluorescent portion (capable of simultaneously altering optical properties and serving as an anchoring group to provide substantivity for the hydrophilic agent).

U.S. Pat. No. 4,739,033 to Morris et al; U.S. Pat. No. 4,728,720 to Morris et al. and U.S. Pat. No. 4,720,719 to Morris et al. teach that 4,4'-stilbenedicarboxylic acid can be copolymerized with aliphatic diols to give materials with good mechanical properties and chemical resistance. U.S. Pat. No. 4,459,402 to Morris et al. and U.S. Pat. No. 4,420,607 to Morris et al. teach that 4,4'-stilbenedicarboxylic acid can be copolymerized with aliphatic diols and terephthalic acid for materials with improved flexural modulus. However, none of these patents teach the use of the copolymers in fabric conditioner compositions. In addition none of the copolymers contain a poly(ethylene glycol) monomeric portion which, in the subject invention, allows the copolymer to be delivered from an aqueous medium (i.e., rinse cycle softeners).

In a related U.S. application, U.S. Ser. No. 636,074, which is assigned to the same assignee as the present invention, the use of the whitening copolymers of the invention in fabric softeners is taught in Examples 16–18. However, there is no teaching in this specification of the use of the copolymer in fabric softener compositions where there is a biodegradable active. Further, there is no teaching of the use of the copolymer in concentrated fabric softener compositions having as much as from about 40% to about 80% by weight of a cationic softening active.

Applicants have shown in this invention that copolymers which function as both soil release agents (such as the poly(ethylene terephthalate)/poly(oxyethylene terephthalate) copolymer discussed above) and as whitening agents can be used in fabric softener compositions which contain biodegradable active as well as in concentrated fabric softener compositions (i.e., containing from about 40–80% of a cationic softening agent wherein the cationic may or may not be biodegradable).

SUMMARY OF THE INVENTION

In one embodiment of the invention, the subject invention provides fabric softener compositions comprising:

(a) from about 2 to 40% of a mixture comprising: (a) 0 to 95% of a cationic ammonium salt selected from the group consisting of alkyl or alkaryl quaternary ammonium salts, alkylpyridinium salts and substituted immidazolium salts; (b) 1–95% of a biodegradable cationic ammonium salt selected from the group consisting of alkyl ester quaternary compounds; (c) 0.01–20% free fatty acids; (d) from 0 to about 95% of a primary, secondary or tertiary amine; (e) from 0 to about 95% of a condensation product of a $C_8$ to $C_{18}$ alkyl carboxylic acid and alkylpolyamine; and (f) from 0 to 40% of a polysiloxane or alkyl, alkoxy or alkylamine modified polysiloxane;

from 0.01 to 10% of a copolymer whitening agent containing at least one fluorescent portion and at least one hydrophilic portion; and (c) remainder water and optional ingredients One especially preferred biodegradable cationic for use in these compositions is:

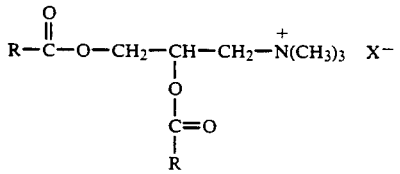

wherein

R is independently selected from $C_{12}$–$C_{24}$ alkyl or alkenyl groups; and $X^-$ is selected from the group consisting of halides, alkyl or aryl carboxylates and alkyl or aryl sulfates.

A specific example of this compound is 1-trimethyl ammonium 2,3-ditallow oxypropane chloride.

The copolymer used in the detergent composition may optionally contain a hydrophobic monomer portion.

In a second embodiment of the invention, the invention is concerned with the use of copolymeric whitening agent in a concentrated fabric softener composition, i.e., a composition comprising 40–80% of a cationic salt active fabric softening agent. In this embodiment, the softening agent may or may not be biodegradable. Also, according to this embodiment, the use of free fatty acid is preferably avoided.

DETAILED DESCRIPTION OF INVENTION

In one embodiment, this invention relates to fabric softener compositions comprising (1) 0–95% of a cationic ammonium salt selected from the group consisting of alkyl or alkaryl quaternary ammonium compounds, alkyl pyridinium salts and substituted imidazolinium salts; (2) 1–95% of a biodegradable cationic ammonium salt selected from the group consisting of alkyl ester quaternary compounds; (3) free fatty acids and (4) polymers which incorporate fluorescent and surface modifying functionalities. The polymers are in turn composed of at least two essential components and one optional monomer. These are (a) a fluorescent monomer, (b) a hydrophilic monomer, and (c) an optional hydrophobic monomer.

In a second embodiment of the invention, it is not required to incorporate a biodegradable cationic but the composition is a concentrated fabric softener composition comprising from 40–80% cationic actives. The use of free fatty acid is preferably avoided. Biodegradability is measured by using a modified STURM test as described in OECD Paris 1981 Test Guideline 301B, Decision of the Council C(81) 30 Final, Consistent with the requirements of official Journal of the European Communities No. L251/179 C.5 BIODEGRADATION.

Essentially the test measures the amount of carbon dioxide evolved from a sample undergoing biodegradation as a percentage of the theoretical maximum. 60% $CO_2$ evolution is required within a 28 day test period before a material can be considered to be readily and ultimately biodegradable.

Cationic Actives

The biodegradable cationic actives of the invention comprise ester-linked quaternary ammonium materials of the following formula:

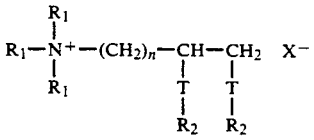

wherein each $R_1$ group is independently selected from $C_1$–$C_4$ alkyl, alkenyl or hydroxyalkyl groups; each $R_2$ is independently selected from $C_{12}$–$C_{24}$ alkyl or alkenyl groups;

T is

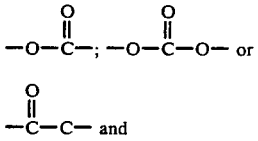

n is an integer from 1–5; and $X^{31}$ is selected from the group consisting of halides, alkyl or aryl carboxylates and alkyl or aryl sulfates.

In a preferred embodiment of the invention, the biodegradable cationic is:

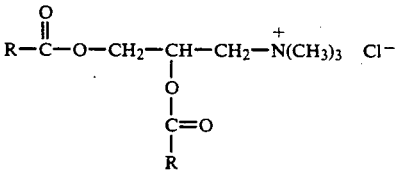

wherein R is independently selected from $C_{12}$–$C_{24}$ alkyl or alkenyl groups.

A specific example of this compound is 1-trimethyl ammonium 2,3-ditallow oxypropane chloride.

The compound is prepared by reacting $HOCH_2CH(OH)CH_2Cl$ with dimethylamine to obtain $HOCH_2CH(OH)CH_2N(CH_3)_2$, followed by treating with hardened tallow fatty acid (greater than 2 moles) to obtain:

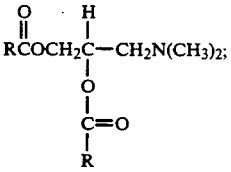

and then quaternizing the nitrogen to obtain the cationic species described above. Other biodegradable quaternary compounds which may be used in the invention are described in U.S. Pat. No. 4,137,180 hereby incorporated by reference into the subject application.

Other Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

Mixtures of various types of cationic active detergents may also be used.

In the first embodiment of the invention, the biodegradable active generally comprises about 0.1 to about 10%, preferably 1% to about 7%, most preferably about 4% to about 6% of the fabric softener. In the second embodiment (i.e., concentrate), the use of a biodegradable active is not required and the active comprises about 40–80%, preferably 50–70% of the composition.

Free Fatty Acids

According to the first embodiment of the invention, 0.01–20% by weight, preferably 0.5–10% by weight free fatty acid are used. Fatty acids which may be used include, for example $C_8$–$C_{24}$ alkyl or alkenyl monocarboxylic acids or polymers thereof. Preferably saturated fatty acids are used, in particular, hardened tallow $C_{16}$–$C_{18}$ fatty acids. Preferably the fatty acid is non-saponified, more preferably the fatty acid is free for example oleic acid, lauric acid or tallow fatty acid.

With regard to second embodiment, use of free fatty acid may range from 0–20% preferably 0–10%. Due to the high level of anionic carryover found in the rinse liquor in the U.S., it is preferred to minimize or eliminate the use of free fatty acid in concentrates.

Optional Ingredients

The compositions of the invention may also contain other ingredients such as detergent enzymes (e.g., lipases, proteases, cellulases, oxidases, amylases and the like), enzyme stabilizers (e.g., propionate, formic acid, low levels of calcium, polyols and boron-containing components), non-aqueous solvents (e.g. ethanol), hydrotropes, additional softening and antistatic agents (i.e., clays, silicones, ethoxylated amines), other soil release polymers and antiredeposition agents and other ingredients including other types of fluorescent whitening agents such as are known in the art (e.g. various Tinopal agents such as Tinopal UNPA, Tinopal CBS-X etc.), perfume, perfume carriers, colorants, anti-foaming agents, anti-wrinkle agents, anti-spotting agents, germicides, fungicides, antioxidants, anti-corosion agents, drape-imparting agents, and ironing aids.

The composition may also contain nonionic fabric softening agents such as lanolin and derivatives thereof.

Copolymers

The copolymers used in the detergent compositions of the invention may be defined by the following formula I:

$$-(A)_n-(B)_m-(C)_p- \qquad (I)$$

wherein A is a fluorescent monomer and is a planar, highly conjugated aromatic moiety bearing the appropriate bifunctionality for incorporation into the main chain of the polymer; Examples of such bifunctional groups include

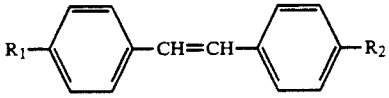

wherein:

(1) $R_1{=}R_2{=}CO_2R$ (wherein the two R groups may be the same or different but are as defined below); (2) $R_1$ may be the same or different than $R_2$ and equals OH or an alcohol having 1–4 carbons (e.g., methanol, ethanol); or (3) $R_1{=}CO_2R$, and $R_2{=}OH$ or an alcohol having 1–4 carbons; and wherein R is an alkyl group having 1–10 carbons, preferably 1–5 carbons, most preferably 1–2 carbons or an aryl group such that there are more than 2 aromatic rings on the monomer;

B is a hydrophilic monomer incorporated to confer hydrophilicity to hydrophobic surfaces;

C is a hydrophobic monomer incorporated to adjust the water solubility and binding strength to hydrophobic surfaces;

n is at least 1 and may range from 1 to 500;

m is at least 5 and may range from 5 to 500; and p may be zero and may range from 0 to 500.

The level of m is chosen to balance the water dispersability, substantivity and hydrophilic character of the deposited coating. In practice, a minimum value for m of approximately 5 is useful.

The monomer A may comprise 1–50 mol % of the composition, the hydrophilic monomer B may comprise 5–45 mol % of the composition and the hydrophobic monomer C, if present, may comprise 1–49 mol % of the composition.

Although A, B, and C are expressed above as a copolymer, it is to be understood that the places of A, B and C may be interchanged.

The copolymers may be further defined by the following formula II:

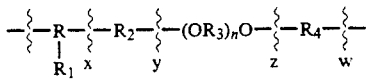

wherein:

R is a difunctional aryl or alkyl group such as, for example, difunctional benzene or napthalene, preferably difunctional benzene or a difunctional straight or branched alkyl chain containing 4 to 16 carbon atoms;

$R_1$ is hydrogen or an aliphatic-containing group having 1–20 carbons, preferably a straight-chained alkyl group having 1–20 carbons, most preferably 1–5 carbons; an aryl, an alkaryl, a secondary amine such as, for example, dialkylamine, an alkali metal sulfonate, an alkali metal carboxylate, an alkyl ether or a halogen atom;

$R_2$ is a straight or branch chain alkoxy group having 1 to 16 carbons, preferably 1 to 4 carbons, or an aryloxy or a substituted aryloxy group;

$R_3$ is a straight or branch chain alkyl group having 1 to 16 carbons, preferably a 1–3 carbons; and $R_4$ is a difunctional fluorescent moiety;

x, which represents the number of monomeric units of the optional hydrophobic group, is selected such that the hydrophobe is present at 0–49 mol % of the composition mixture when the copolymer is polymerized;

y is selected such that the $R_2$ group is present at 0–45 mol % of the mixture;

z is selected such that the $(OR_3)_n$ group is present at 5–45 mol % of the mixture wherein n is an integer between 2 and 200, preferably 10 to 25; and w is selected such that the $R_4$ is present at 1–50 mol % of the reaction mixture.

As discussed above, the fluorescent monomer (represented above by $R_4$) is a planar, highly conjugated aromatic moiety bearing the appropriate bifunctionality for incorporation into the main chain of the polymer. Preferably, the fluorescent monomer should absorb UV light (260–400 nm) and emit in the blue visible range (400–490 nm). Preferred monomers are the stilbene derivatives such as bis(carbomethoxy) stilbene, bis(hydroxy) stilbene, bis(amino) stilbene, and mixtures of the above. Examples of difunctional stilbenes which may be used in the present invention include 4,4'-bis (carbomethoxy)stilbene, 4,4'-bis(hydroxy)stilbene, 4,4'-bis-(aminostilbene) and 1,4-bis(2(-4'-carbomethoxy styrenyl)) benzene. Still other examples of fluorescers which can suitably be difunctionalized by those skilled in the art may be found in H. Hefti, "Fluorescent Whitening Agents", R. Anliker and G. Muller, Eds., Georg Thieme Publishers, Stuttgart, 1975.

Particularly preferred fluorescent monomers are those like 4,4'-bis (carbomethoxy)stilbene which is white in color and straightforward to prepare. As discussed above, the conjugated aromatic moiety may be added as 1–50 mol % of the reaction mixture, preferably 30–50 mol %. In formula II above, w may range from about 1–500.

It should be understood that the fluorescent monomer (represented by $R_4$) may comprise a difunctional group which is a highly conjugated aromatic ring system having more than 2 aromatic rings. An example of such a difunctional compound is 1,4-bis (2(-4'-carbomethoxy styrenyl)) benzene wherein $R_4$ may be represented in formula II above as follows:

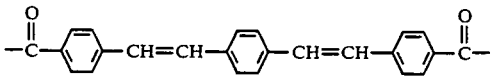

The hydrophilic component (represented by $R_2$ and $(OR_3)_n$) is incorporated to confer hydrophilicity to naturally hydrophobic surfaces such as soiled cotton or polyester as well as to facilitate transfer of the polymer through an aqueous medium. Hydrophilic monomers which may be used include, but are not limited to the $\alpha,\omega$-diols or alkylene glycols such as ethylene glycol, propylene glycol, butylene glycol, and mixtures of the three. Other hydrophilic monomers which may be used as $R_2$ are based on simple sugars or poly(saccharides), or $\alpha,\omega$ poly(ols) which may include glucose, sucrose, sorbitol, or glycerol.

In a preferred embodiment of the invention, $R_2$ is an ethylene glycol and $(OR_3)_n$ is a poly(ethylene glycol). Suitable polyethylene glycols are those manufactured by Union Carbide and sold under the CARBOWAX® tradename. Examples include CARBOWAX® 300, 600, 1000, 3350 and the like. It is not absolutely required that the ethylene glycol monomeric unit be present as part of the final copolymer although generally the molecule is present as 5–30 mol %, preferably 10–20% mol % of the reaction mixture.

The poly(ethylene glycol), however, must be present in at least sufficient quantity to ensure that the final copolymer may be delivered through an aqueous medium. In general, this monomer is present as 5–45 mol %, preferably 30–45% of the reaction mixture.

In general, applicants have found that the reaction works favorably when the poly(ethylene glycol) is mixed with the ethylene glycol in a molar ratio of about 3:1. There is no criticality to this ratio, however, and the copolymer will form within any of the broad ranges described above.

The hydrophobic monomer which may be optionally incorporated is used to adjust the water solubility and binding strength of the copolymer to hydrophobic surfaces. Suitable hydrophobic monomers which may be used include long chain aliphatic $\alpha,\omega$-diols, $\alpha,\omega$-diamines, or $\alpha,\omega$-dicarboxylates. Another suitable class of hydrophobic monomers include the aromatic 4,4'-phenylenediols, 4,4'-biphenols, or 4,4'-dihydroxydiphenyl ethers, as well as the analogous dicarboxy or diamino species. Especially preferred monomers are terephthalic acid and hexanedioic acid.

These monomers are generally added as 0–49 mol % of the reaction mixture, preferably 10–25 mol %.

In one especially preferred embodiment of the invention, the fluorescent monomer is 4,4'-bis(carbomethoxy)stilbene, the hydrophilic monomer is a mixture of poly(ethylene glycol) and ethylene glycol and the hydrophobic monomer is terephthalic acid.

The molecular weight of the copolymers may range from 3000 to 100,000, preferably 3000 to 50,000, and most preferably 3000 to about 25,000. The ratio of monomers can vary broadly depending upon the end use requirements such as whether the polymer is being used for soil release, antideposition properties, or enzyme stabilization.

However, as is usual for soil release agents, some balance is generally sought between hydrophilic and hydrophobic properties. These can be fine tuned by those skilled in the art.

As mentioned above, in one embodiment of the invention, the copolymers of the present invention may be based upon the condensation product of dimethyl terephthalate, ethylene glycol, poly(ethylene glycol), and 4,4'- bis (carbomethoxy)stilbene.

The polyethylene glycol used will generally have a molecular weight ranging from about 200 to about 4,000.

These components may be combined via a 1-step transesterification reaction as set forth below:

POLYMERIZATION SCHEME

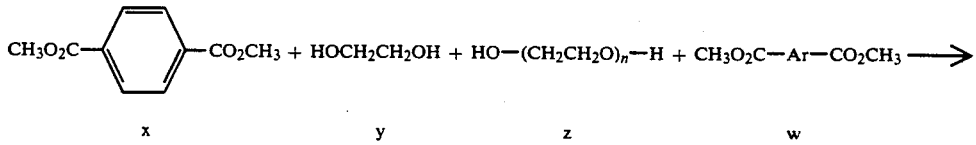

-continued

POLYMERIZATION SCHEME

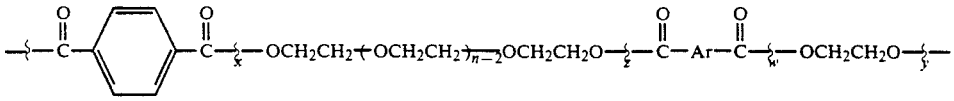

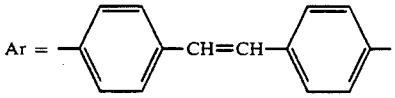

x = 0–49 mol %
y = 5–45 mol %
z = 5–45 mol %
n−2 = 1–70
w = 1–50 mol 5

According to the above scheme, the hydrophobic poly(ethylene terephthalate) unit has been incorporated to adhere the polymer to hydrophobic surfaces such as oily soil residue on cotton fabric or polyester-based fabric. The hydrophilic poly(ethylene glycol) unit has been incorporated to facilitate polymer transfer through an aqueous medium and to modify a hydrophobic surface to a more hydrophilic state, thereby deterring oily soil build-up. The 4,4'-bis (carbomethoxy)stilbene unit has been incorporated to provide optical brightening in the form of blue fluorescence. The 4,4'-bis (carbomethoxy)stilbene was synthesized via Wittig reaction between (4-carbomethoxy) benzyltriphenylphosphonium bromide and methyl 4- formylbenzoate using sodium methoxide base in the presence of methanol/toluene solvent and affords a cis/trans mixture of isomers.

Yields ranged typically from 65–90%. Pure isomeric forms of 4,4'-bis (carbomethoxy)stilbene could be obtained by washing the mixture several times with 2:1 methanol/toluene solution, which selectively dissolves the cis isomer and leaves the trans form insoluble. 4,4'-bis (carbomethoxy)stilbene can be used as an isomeric mixture or as a pure isomeric form. Polymers were obtained by charging the reaction vessel with 1 eq. of the diester species, a slight excess of the diol species, and suitable catalysts such as $Ca(OAc)_2$. The contents of the reaction vessel were heated between 180°–250° C. for between 5–24 hours. The resulting materials ranged in molecular weight from 3000–75,000 and exhibited fluorescence in the presence of long wave UV light.

Compositions

The surface active agents, optional ingredients and copolymers described above may be formulated into various fabric softener compositions.

Specifically, the composition is a fabric softener composition comprising from 2 to about 40% of a mixture comprising: (a) from 0 to about 95% of a cationic ammonium salt selected from the group consisting of alkyl or alkaryl quaternary ammonium salts, alkylpyridinium salts, and substituted imidazolinium salts; (b) a biodegradable cationic ammonium salt selected from the group consisting of alkyl ester quaternary compounds; (c) from 0 to about 95% of primary, secondary or tertiary amines; (d) from 0 to about 95% of the condensation product of a $C_8$ to $C_{18}$ alkyl carboxylic acid and an alkylpolyamine; (e) from 0 to about 40% of a polysiloxane or alkyl, alkoxy, or alkylamine modified polysiloxane; and (f) 0–20% free fatty acid.

The remainder of the composition is water and optional ingredients.

More specifically, the subject invention is concerned with the use of novel copolymeric whitening agents in various specific fabric softener compositions, for example, fabric softener compositions in which biodegradable actives such as those described above are used.

One preferred example of such a biodegradable active has the formula:

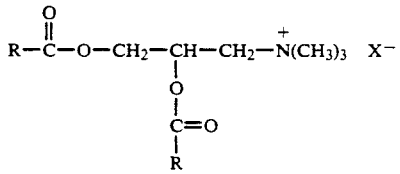

wherein

R is independently selected from $C_{12}$–$C_{24}$ alkyl or alkenyl groups. A specific example of this compound is 1-trimethyl ammonium 2,3-ditallow oxypropane chloride; and $x^-$ is selected from the group consisting of halides, alkyl or aryl carboxylates and alkyl of aryl sulfates.

Alternatively, the invention is concerned with the use of these polymers in concentrated fabric softener compositions, i.e., compositions having 40%–80% fabric softener.

The following examples are intended to further illustrate the invention and are not intended to be limiting in any way.

EXAMPLE 1

Synthesis and Characterization of Fluorescent Monomer (4,4'-bis(carbomethoxy)stilbene)

4,4'-bis(carbomethoxy)stilbene: To a 1 L 3-neck round bottom flask fitted with a glass stopper, rubber septum, and reflux condenser fitted with a nitrogen inlet tube, was added 20.0 g (39.77 mmol) (4-carbomethoxy) benzyltriphenylphosphonium bromide; 7.83 g (47.73 mmol) methyl 4-formylbenzoate; and 110 mL 2:1 methanol: toluene. After the starting material dissolved, 10.0 mL (43.75 mmol) 25% sodium methoxide solution in methanol was added dropwise over several minutes. The reaction vessel was heated at reflux for 30 minutes. After cooling to room temperature, the reaction vessel was cooled at 0° C. for several hours. The resulting precipitate was filtered, washed with 2:1 methanol: toluene, and dried in a vacuum oven to afford 5.54 g (72%) of the compound as a 57:43 mixture of cis: trans isomers.

Cis isomer mp.=109°-111° C. (lit[8] 109°-111° C.); $^1$H NMR ($CDCl_3$, 200 MHz) δ 3.90 (s, 6 H), 6.72 (s, 2H), 7.27 (d,J=8.3 Hz, 4H), 7.90 (d,J=8.3 Hz, 4H).

Trans isomer mp.=228°-230° C. (lit[8] 227°-228° C.); $^1$H NMR ($CDCl_3$, 200 MHz) δ 3.94 (s, 6H), 7.27 (s, 2H), 760 (d,J=8.4 Hz, 4H), 8.05 (d,J=8.4 Hz, 4H).

8 B. H. Lee and C. S. Marvel, *J. Polym. Sci., Polym. Chem. Ed.*, 20, 393 (1982). The reaction scheme is set forth below:

Scheme 1

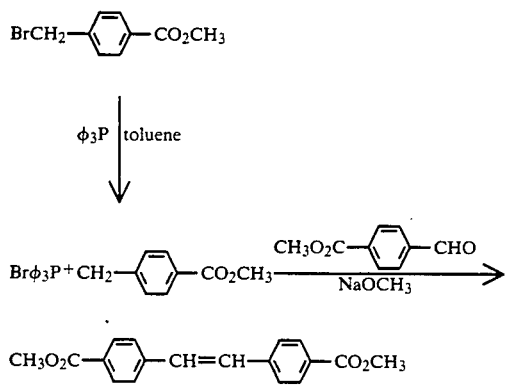

EXAMPLE 2

General Procedure for Low (3000) Molecular Weight Fluorescent Surface-Modifying Polymers To a 250 mL 3-neck round bottom flask fitted with an overhead stirrer, distillation condenser, and nitrogen inlet tube was added 19.41 g (0.01 mol) dimethyl terephthalate, 9.46 g (0.153 mol) ethylene glycol, 54.01 g (0.090 mol) poly (ethylene glycol) MW=600, 7.40 g (0.025 mol) 4,4'-bis (carbomethoxy)stilbene, 0.135 g (0.876) mmol) Ca $(OAc)_2$, 0.135 g (0.463 mmol) $Sb_2O_3$, and 0.135 g (0.613 mmol) 2,6-di-tert butyl-4-methylphenol. The reaction vessel was heated at 175° C. for 2 h. The temperature was raised to 205° C., at which point MeOH began to distill off, and was heated at that temperature for 5 h. The temperature was further raised to 220° C. and heated at that temperature for an additional 19 h. The reaction mixture was allowed to cool to room temperature under nitrogen.

$^1$H NMR ($CDCl_3$, 300 MHz), δ 3.68 (broad s, $(—CH_2CH_2O)_x—$), 385 (t,J=4.7 Hz, $—CO_2CH_2CH_2O—(CH_2CH_2O)x—$), 3.99 (t,J=4.7 Hz, $HOCH_2CH_2O_2C—C_6H_4—CO—$), 4.49 (t,J=4.7 Hz, $HOCH_2CH_2O_2C—C_6H_4—CO—$), 4.50 (t,J=4.7 Hz, $—CO_2CH_2CH_2O—(CH_2CH_2O)_x—$), 4.71 (s, $—CO_2CH_2CH_2O_2C—$), 6.72 (s, $—COC_6H_4CH=CHC_6H_4CO—$cis), 7.24 (s, $—COC_6H_4CH=CHC_6H_4CO—$trans), 7.28 (d,J=8.3 Hz—$COC_6H_4CH=CHC_6H_4CO—$cis), 7.60 (d,J=8.3 Hz—$COC_6H_4CH=CHC_6H_4CO—$trans), 7.91 (d,J=8.3 Hz—$COC_6H_4CH=CHC_6H_4CO—$cis), 8.06 (d,J=8.3 Hz—$COC_6H_4CH=CHC_6H_4CO—$trans), 8.12 (s, $—COC_6H_4CO—$).

EXAMPLE 3

General Procedure for High (50,000-75,000) Molecular Weight Fluorescent Surface-Modifying Polymers:

To a 250 mL 3-neck round bottom flask fitted with an overhead stirrer, distillation condenser, and nitrogen inlet tube was added 19.41 g (0.01 mol) dimethyl terephthalate, 9.46 g (0.153 mol) ethylene glycol, 54.01 g (0.090 mol) poly(ethylene glycol) MW=600, 7.40 g (0.025 mol) 4,4'-bis(carbomethoxy)stilbene, 0.135 g (0.876mmol) Ca $(OAc)_2$, 0.135 g (0.463 mmol) $Sb_2O_3$, and 0.135 g (0.613 mmol) 2,6-di-tert-butyl-4-methylphenol. The reaction vessel was heated at 175° C. for 2 h. The temperature was raised to 205° C., at which point MeOH began to distill off, and was heated at that temperature for 5 h. The temperature was further raised to 220° C. and heated at that temperature for an additional 19 h. After this period, the reaction vessel was placed under vacuum (15-20 torr) and kept at 220° C. for 5 h. The reaction mixture was allowed to cool to room temperature under nitrogen.

$^1$H NMR ($CDCl_3$, 300 MHz), δ 3.68 (broad s, $(—CH_2CH_2O)_x—$), 385 (t,J=4.7 Hz, $—CO_2CH_2CH_2O—(CH_2CH_2O)x—$), 4.50 (t,J=4.7 Hz, $—CO_2CH_2CH_2O—(CH_2CH_2O)_x—$), 4.71 (s, $—CO_2CH_2CH_2O_2C—$), 6.72 (s, $—COC_6H_4CH=CHC_6H_4CO—$cis), b 7.24 (s, $—COC_6H_4CH=CHC_6H_4CO—$trans), 7.28 (d,J=8.3 Hz—$COC_6H_4CH=CHC_6H_4CO—$cis), 7.60 (d,J=8.3 Hz—$COC_6H_4CH=CHC_6H_4CO—$trans), 7.91 (d,J=8.3 Hz—$COC_6H_4CH=CHC_6H_4CO—$cis), 8.06 (d,J=8.3 Hz—$COC_6H_4CH=CHC_6H_4CO—$trans), 8.12 (s, $—COC_6H_4CO—$).

It should be added that, although the current examples refer to polyester, suitable polyamides may be employed and are also contemplated to fall within the scope of the current invention.

EXAMPLE 4

Polymers Prepared and Their UV Absorbance

A series of polymers were synthesized according to the procedures described in the EXPERIMENTAL section and described in Table 1. The polymers were characterized by UV spectroscopy and gel permeation chromatography (GPC). Molar extinction (ε) was calculated based upon Beer's Law equation $\epsilon=A/cl$, where A=absorbance as measured by the UV spectrophotometer, l=path length, and c=the molar concentration. In the case of these polymers, molarity was based upon the molecular weight of the average repeating unit. The characterization results are presented in Table 2 found after Table 1:

TABLE 1

| Polymer | DMT | CMS | EG | PEG | MW |
|---|---|---|---|---|---|
| A | 0.495 | 0.005 | 0.13-0.15 | 0.35-0.37 | 3,000 |
| B | 0.450 | 0.050 | 0.13-0.15 | 0.35-0.37 | 52,600 |
| C | 0.400 | 0.100 | 0.13-0.15 | 0.35-0.37 | 19,800 |
| D | 0.325 | 0.175 | 0.13-0.15 | 0.35-0.37 | 46,000 |
| E | 0.25 | 0.250 | 0.13-0.15 | 0.35-0.37 | 5,200 |
| F | 0.125 | 0.375 | 0.13-0.15 | 0.35-0.37 | 11,600 |
| Comparative Polymer | | | | | |
| | 0.50 | 0.00 | 0.13-0.15 | 0.35-0.37 | 23,000 |

DMT = dimethylterephthalate
CMS = 4,4'-bis(carbomethoxy)stilbene
EG = ethylene glycol
PEG = poly(ethylene glycol), molecular weight 600
MW = molecular weight The comparative polymer is a polyethylene terephthalate/polyoxyethylene terephthalate polymer (PET-POET).

TABLE 2

| Polymer | λ Max | E Max | ε (1/mol-cm) | I |
|---|---|---|---|---|
| A | 335 nm | 384 nm | 174 | 8.4 |
| B | 335 nm | 384 nm | 1,750 | 38.3 |
| C | 335 nm | 384 nm | 3,130 | 70.7 |
| D | 335 nm | 384 nm | 4,480 | 84.1 |
| E | 335 nm | 384 nm | 5,900 | 99.1 |
| F | 335 nm | 384 nm | 10,300 | 135.4 |
| Comparative polymer | 298 nm | — | — | 1 |

ε = Molar extinction coefficient
λ Max = Wavelength of Maximum Absorbance
E Max = Wavelength of Maximum Florescence Emission
I = Fluorescence Intensity, Relative to Poly(ethylene terephthalate)/poly(oxyethylene terephthalate)standard.

As can be seen from Table 2, the fluorescence intensity of the copolymer of the invention is significantly higher than the comparative which is used as a standard. Since the actual value of I for the comparative polymer was 4.6, each of the recorded values of I for polymers A-F was divided by 4.6 to obtain the values listed in Table 2.

EXPERIMENTAL

UV absorbance spectra were obtained on a Beckman DU-65 spectrophotometer. Chloroform was used as the sample and reference solvent. Fluorescence spectra were obtained on a Perkin-Elmer MPF-66 Fluorescence Spectrophotometer at a concentration of 0.0011 g fluorescent polymer/liter and are uncorrected. Chloroform was used as the sample solvent. Fluorescence emission data were obtained by radiating the samples at λ max (335 nm) and scanned from 350–500 nm at 120 nm/min. Emission and exitation slit widths=2.0 nm.

EXAMPLE 5

Brightness Evaluation

Brightness was measured by the following method:

Fifteen panelists were enlisted to judge the relative brightness of polyester and cotton test clothes which were dosed either with Tinopal UNPA or our fluorescent polymer, or left virgin. The experiments were run in the presence or absence of surfactant. All brightness assessment was done in our light room under long wave ultraviolet light. The general procedure for cloth preparation is as follows:

All test cloths were washed three times with a detergent composition (Example 6) w/o fluorescer to remove incidental residues. 2 g of the composition formulation w/o fluorescer and the appropriate amount of fluorescent polymer (the molar concentration—based upon amount of fluorescent moiety—of a typical commercial liquid detergent w/fluorescer) were run in a terg-o-tometer wash at 40° C., at 120 ppm Ca/Mg 2:1, and for 14 min. The cloths were then rinsed with tap water and dried in a conventional clothes drier for 10–15 minutes.

Evaluation

The results with a 51,000 MW polymer containing 5 mol % fluorescer are shown below in Table 3 below:

TABLE 3

| | NUMBER OF PANELISTS WHO SELECTED BRIGHTEST CLOTH | | | |
|---|---|---|---|---|
| Cloth Containing | Polyester w/surfactant | Polyester w/o surfactant | Cotton w/surfactant | Cotton w/o surfactant |
| Fluorescent Polymer | 14 | 13 | 0 | 0 |
| Tinopal UNPA | 1 | 2 | 15 | 15 |
| Virgin Cloth | 0 | 0 | 0 | 0 |

It is clear from these results that all panelists could detect a brightening effect with the fluorescent polymer of the invention, relative to an untreated cloth. Moreover, the overwhelming majority of panelists believed that polyester test cloths washed with the polymer of the present invention were brighter than those washed with Tinopal, with or without surfactant. Tinopal, on the other hand, is more effective in brightening cotton. This example demonstrates that the polymers of the instant invention are capable of depositing from a detergent composition onto hydrophobic fabric.

EXAMPLES 6–8

Use of copolymers of the invention in Fabric Softener Compositions.

| | wt. % | | |
|---|---|---|---|
| Ingredient | 6 | 7 | 8 |
| Dimethyldialkyl ammonium chloride | 3.2 | 6.5 | 6.25 |
| Trimethylalkyl ammonium chloride | 0.6 | 0.9 | — |
| Alkyl amidoethyl alkyl imidazoline | 3.3 | 16.0 | — |
| Polydimethyl siloxane | 0.1 | 0.5 | — |
| Ethanol | 0.7 | 1.4 | — |
| Calcium chloride | 0.7 | 0.3 | 0.1 |
| FW Polyester | | 0.01 to 10.0 | |
| Water | | to 100.0 | |

EXAMPLE 9

Soil Release Polymers in a QBC Based Rinse Conditioner

A polymer having the ratio of whitener: DMT:PEG:EG of 1:0:0.72:1.22 was dispersed in water at 70° C. and the dispersion mixed with molten a quaternized biodegradable cationic (QBC) active such that the final composition of the rinse conditioner was:

| | Wt % |
|---|---|
| QBC* | 5 |
| HTFA (hardened tallow) | 0.63 |
| Polymer | 1 |
| Water | to balance |

The composition was prepared by adding the molten QBC over a period of at least one minute to water at 70° C. to 80° C. with constant stirring to form a dispersion The control was the above formulation with no polymer present.

To evaluate soil release properties, 3 polyester knit swatches (3"×10") were rinsed in 1 liter of tap water containing 2 ml of the rinse conditioner for 5 mins. The cloths were then dried and stained with 100 ul of olive oil containing 0.06% sudan red dye. The stain was allowed to wick out and then the reflectance of the cloth was measured. The cloths were washed off for 15 minutes at 40° C. in 1 liter wirral water containing 5 gallons per liter New System Persil Automatic and then rinsed for 5 minutes in tap water. The cloths were line dried and then the reflectance redetermined. Percent Detergency (i.e., soil release) was assessed by reflectance spectroscopy using an ICS Micromatch Reflectance Spectrophotometer. The percent anti-fade protection was calculated as the change in reflectance (Ks) from the untreated to the treated cloths, relative to the untreated cloths, i.e., $$\text{Percent anti-fade protection} = \frac{(Ks\ \text{untreated} - Ks\ \text{treated})}{Ks\ \text{untreated}}$$

The fluorescence delivery was assessed by a paired comparison of polyester knit cloth rinsed in wirral water containing 2 ml/1 of rinse conditioner. The cloths were rinsed for 5 mins, dried and then compared under a UV light centered at 366 nm.

| Formulation | Results % Detergency | Whiteness votes |
|---|---|---|
| QBC + Polymer | 96 | 12 |
| QBC Alone | 49 | 0 |

This example clearly shows that the use of the polymer in a fabric softener comprising a biodegradable cationic is superior to the use of composition without the polymer.

EXAMPLE 10

Soil Release Polymers in a Dihardened Tallow Dimethyl Ammonium Chloride (DHTDMAC) Concentrate Based Rinse Conditioner A DHTDMAC based rinse conditioner containing 16% of 4.1 DHTDMAC:HTFA (i.e., 12.8% DHTDMAC and 3.2% HTFA) and 1% of the polymer of Example 9 was prepared as above. The dose used for evaluation was 0.67 ml. The control was an equivalent concentration of active without the polymer.

Soil release and fluorescence delivery were assessed as above.

| Formulation | Results % Detergency | Whiteness votes |
|---|---|---|
| DHTDMAC + Polymer | 94 | 12 |
| DHTDMAC Alone | 41 | 0 |

Again, this example shows that the effect of the polymer in a concentrate is far superior to the effect of the concentrate alone.

We claim:

1. A fabric softener composition comprising:

(a) 2 to 40% of a mixture comprising:

(1) 0 to 95% of a cationic ammonium salt selected from the group consisting of alkyl or alkenyl quaternary ammonium salts, alkyl pyridinium salts substituted immidazolinium salts;

(2) 1-95% of a biodegradable cationic ammonium salt selected from the group consisting of alkyl ester quaternary compounds;

(3) 0.01 to 20% free fatty acid;

(4) 0 to about 95% primary, secondary or tertiary amine;

(5) from 0% to 95% of a condensation product of $C_8$ to $C_{18}$ alkyl carboxylic acid and alkylpolyamine; and (6) 0 to 40% of a polysiloxane or alkyl, alkoxy, or alkylamine modified polysiloxane;

(b) a copolymer whitening agent containing a fluorescent group and a hydrophilic group; and (c) water;

wherein the copolymer (b) has the formula

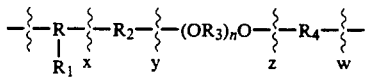

wherein

R is a difunctional aryl group or a difunctional straight or branched alkyl chain having 4 to 16 carbons;

$R_1$ is hydrogen, an aliphatic group having 1 to 20 carbons, an aryl, an alkaryl, a secondary amine, an alkali metal sulfonate, an alkali metal carboxylate, an alkyl ether or a halogen atom;

$R_2$ is a straight or branch chain alkoxy group having 1 to 16 carbons, an aryloxy or a substituted aryloxy group;

$R_3$ is a straight or branch chain alkyl group having 1 to 16 carbons; and $R_4$ is a difunctional fluorescent moiety;

x is selected such that the difunctional hydrophobic group is present at 0–49 mol % of the composition mixture when the copolymer is polymerized;

y is selected such that the $R_2$ group is present at 0–45% mol % of the mixture;

z is selected such that the $(OR_3)_n$ group is present at 5–45 mol % of the mixture wherein n is an integer between 2 and 200; and w is selected such that the $R_4$ group is present at 1–50 mol % of the reaction mixture.

2. A composition according to claim 1, wherein R is difunctional benzene or napthalene.

3. A composition according to claim 1, wherein $R_1$ is hydrogen or a straight chain alkyl group having 1 to 12 carbon atoms.

4. A composition according to claim 1, wherein $R_2$ is an alkoxy group having 1 to 4 carbons.

5. A composition according to claim 1 wherein R is

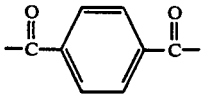

and $R_1$=H.

6. A composition according to claim 1 wherein $R_2$ is $-OCH_2CH_2-$.

7. A composition according to claim 1 wherein $R_3$ is $-CH_2CH_2-$.

8. A composition according to claim 1 wherein $R_4$ is

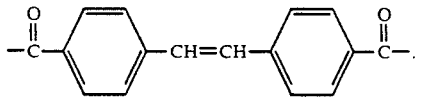

9. A composition according to claim 1 wherein $R_4$ is

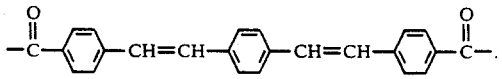

10. A composition according to claim 1 wherein R is

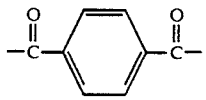

and $R_1$ is H;
$R_2$=—$OCH_2CH_2$—;
$R_3$=—$CH_2CH_2$—; and
$R_4$=

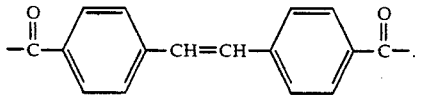

11. A composition according to claim 1 wherein R is

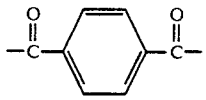

and $R_1$ is H;
$R_2$=—$OCH_2CH_2$—;
$R_3$=—$CH_2Ch_2$—; and
$R_4$=

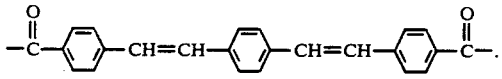

12. A composition according to claim 1 containing a polymer prepared by polymerizing a mixture of dimethyl terephthalate, ethylene glycol, polyethylene glycol of MW 200–3000 and 4,4'-bis(carbomethoxy stilbene).

13. A composition according to claim 1 containing a polymer prepared by polymerizing a mixture of dimethyl terephthalate, ethylene glycol, polyethylene glycol of MW 200–4000 and 1,4-bis(2(-4'- carbomethoxystyrenyl)) benzene.

14. A composition according to claim 1 comprising at least 4% free fatty acid, at least 15% active and no more that 80% water.

15. A composition according to claim 1, wherein the biodegradable cationic active is

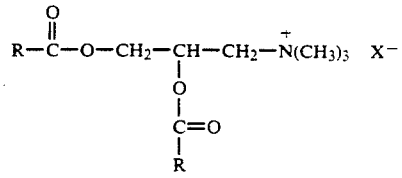

wherein
R is independently selected from $C_{12}$–$C_{24}$ alkyl or alkenyl groups; and
$X^-$ is selected from the group consisting of halides; alkyl or aryl carboxylates; and alkyl or aryl sulfates.

16. A composition according to claim 15, wherein the cationic active is 1-trimethyl ammonium 2,3 ditallow oxypropane chloride.

17. A fabric softener composition comprising:
(a) 40 to 80% of a mixture comprising:
(1) 15 to 95% of a cationic ammonium salt selected from the group consisting of alkyl or alkenyl quaternary ammonium salts, alkyl pyridinium salts and substituted immidazolinium salts and alkyl ester quaternary compounds;
(2) 0 to 20% free fatty acid;
(3) 0 to about 95% primary secondary or tertiary amine;
(4) from 0% to 95% of a condensation product of $C_8$ to $C_{18}$ alkyl carboxylic acid and alkyl polyamine; and
(5) 0 to 40% of a polysiloxane or alkyl, alkoxy, or alkylamine modified polysiloxane;
(b) a copolymer whitening agent containing a fluorescent group and a hydrophilic group; and
(c) remainder water and optional ingredients,
wherein the copolymer (b) has the formula

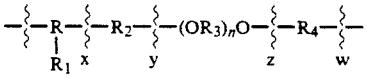

wherein
R is a difunctional aryl group or a difunctional straight or branched alkyl chain having 4 to 16 carbons;
$R_1$ is hydrogen, an aliphatic group having 1 to 20 carbons, an aryl, an alkaryl, a secondary amine, an alkali metal sulfonate, an alkali metal carboxylate, an alkyl ether or a halogen atom;
$R_2$ is a straight or branch chain alkoxy group having 1 to 16 carbons, an aryloxy or a substituted aryloxy group;
$R_3$ is a straight or branch chain alkyl group having 1 to 16 carbons; and
$R_4$ is a difunctional fluorescent moiety;
x is selected such that the difunctional hydrophobic group is present at 0–49 mol % of the composition mixture when the copolymer is polymerized;
y is selected such that the $R_2$ group is present at 0–45% mol % of the mixture;
z is selected such that the $(OR_3)_n$ group is present at 5–45 mol % of the mixture wherein n is an integer between 2 and 200; and
w is selected such that the $R_4$ group is present at 1–50 mol % of the reaction mixture.

* * * * *